US008654035B2

(12) United States Patent
Proffitt et al.

(10) Patent No.: US 8,654,035 B2
(45) Date of Patent: Feb. 18, 2014

(54) REFLECTOR LATCHING MECHANISM FOR SEGMENTED REFLECTORS USED IN SATELLITE COMMUNICATION SYSTEMS

(75) Inventors: Michael A. Proffitt, Burnsville, NC (US); John W. Gurney, Great Falls, VA (US)

(73) Assignee: AvL Technologies, Inc., Asheville, NC (US)

( * ) Notice: Subject to any disclaimer, the term of this patent is extended or adjusted under 35 U.S.C. 154(b) by 899 days.

(21) Appl. No.: 12/821,244

(22) Filed: Jun. 23, 2010

(65) Prior Publication Data

US 2010/0328190 A1 Dec. 30, 2010

Related U.S. Application Data

(60) Provisional application No. 61/269,643, filed on Jun. 25, 2009.

(51) Int. Cl.
*H01Q 15/20* (2006.01)

(52) U.S. Cl.
USPC ..... 343/915; 343/912

(58) Field of Classification Search
USPC ..... 343/915
See application file for complete search history.

(56) References Cited

U.S. PATENT DOCUMENTS 4,893,132 A 1/1990 Habibi
7,023,401 B2 * 4/2006 Thrash et al. ..... 343/915

* cited by examiner

*Primary Examiner* — Jacob Y Choi
*Assistant Examiner* — Kyana R McCain
(74) *Attorney, Agent, or Firm* — The Van Winkle Law Firm; David M. Carter

(57) ABSTRACT

There is provided an antenna reflector including at least first and second reflector segments, each having first and second sides. The first and second reflector segments being configured to be connected together wherein the first sides of the first and second reflector segments define a substantially continuous surface of an antenna reflector. A first latch member is attached to the second side of the first reflector segment and a second latch member is attached to the second side of the second reflector segment. Each latch member includes an abutting surface which contacts one another when the first and second reflector segments are connected together. At least one protrusion extends from the abutting surface of the first latch member. There is at least one recess in the abutting surface of the second latch member. The protrusion is received in the recess when the respective abutting surfaces contact one another.

31 Claims, 11 Drawing Sheets

REFLECTOR LATCHING MECHANISM FOR SEGMENTED REFLECTORS USED IN SATELLITE COMMUNICATION SYSTEMS

This is a U.S. non-provisional application relating to and claiming the benefit of U.S. Provisional Patent Application Ser. No. 61/269,643, filed Jun. 25, 2009.

BACKGROUND OF THE INVENTION

This invention relates to segmented antenna reflectors used in satellite communication systems. More particularly, it relates to latching systems for such segmented reflectors. Mobile ground-based transceivers for satellite communication systems include large dish-shaped antenna reflectors for sending and receiving RF Signals to and from orbiting satellites. Ground satellite communication systems are increasingly being used in remote locations. It is important to be able to conveniently and expeditiously ship disassembled components, including the reflector, to the location of use. A disassembled reflector often includes a hub panel segment and a plurality of circumferential panel segments which surround the hub. During transport, the circumferential panel segments are disassembled from the hub. Ease of assembly and disassembly of these panel segments is very important, particularly for military applications.

In the prior art systems, these panel segments often include pins and corresponding holes for connecting adjacent circumferential panel segments together. In addition, there are pins and corresponding holes between the circumferential panel segments and the hub panel segment. These pin and hole connections are called latch blocks. These latch blocks have two functions, one is to connect the panel segments and the other is to set the shape of the reflector in a predetermined form. In order to set the shape of the reflector, the latch blocks must be very precise. This very precision tends to make the panel segments, in particular, circumferential segments, difficult to assemble and disassemble. Users in the field have found it difficult to quickly and efficiently assemble and disassemble a portable reflector which includes a pin and hole type of latch arrangement.

SUMMARY OF THE INVENTION

In accordance with one form of this invention, there is provided an antenna reflector including at least first and second reflector segments. The first and second reflector segments each having first and second sides. The first and second reflector segments are configured to be connected together wherein the first sides of the first and second reflector segments together define a substantially continuous surface of an antenna reflector. A first latch member is attached to the second side of the first reflector segment and a second latch member is attached to the second side of the second reflector segment. Each latch member includes an abutting surface. The respective abutting surfaces of each latch member contact one another when the first and second reflector segments are connected together. At least one protrusion extends from the abutting surface of the first latch member. There is at least one recess in the abutting surface of the second latch member. The protrusion is received in the recess when the respective abutting surfaces contact one another.

In accordance with another form of this invention, there is provided a latch system for connecting first and second reflector segments together and second antenna reflector segments together. The first and second reflector segments each having first and second sides. The first and second reflector segments are configured to be connected together wherein the first sides of the first and second reflector segments together define a substantially continuous surface of an antenna reflector. A first latch member is attached to the second side of the first reflector segment and a second latch member is attached to the second side of the second reflector segment. Each latch member includes an abutting surface. The respective abutting surfaces of each latch member contact one another when the first and second reflector segments are connected together. At least one protrusion extends from the abutting surface of the first latch member. There is at least one recess in the abutting surface of the second latch member. The protrusion is received in the recess when the respective abutting surfaces contact one another.

In the preferred embodiment, the protrusion has an upper and lower surface and the recess has an upper and lower wall. The upper surface of the protrusion is immediately adjacent to the upper wall of the recess and the lower surface of the protrusion is immediately adjacent to the lower wall of the recess when the respective abutting surfaces contact one another. The contact of the respective abutting surfaces of the first and second latch members maintains the first and second reflector segments in a predetermined configuration in a first axis. The immediate adjacency of the upper surface of the protrusion with the upper wall of the recess and the immediate adjacency of the lower surface of the protrusion with the lower wall of the recess maintain the first and second reflector segments in a predetermined configuration in a second axis.

In one embodiment of the invention, the recess has left and right side walls and the protrusion has left and right surfaces. The left side wall is immediately adjacent to the left side surface and the right side wall is immediately adjacent to the right side surface when the respective abutting surfaces contact one another. The immediate adjacency of the left side surface of the protrusion with the left side wall of the recess and the immediate adjacency of the right side surface of the protrusion with the right side wall of the recess maintain the first and second reflector segments in a predetermined configuration in a third axis.

In another embodiment of the invention, the sides of the recess are open so that the attachment of the first and second reflector segments to one another may be done more easily.

DESCRIPTION OF THE PREFERRED EMBODIMENTS

Applicants' invention enables one to achieve precision in connecting reflector segments together and setting the shape of the reflector. It also enables ease, accuracy and repeatability of assembly of the reflector and it reduces the number of required personnel for such assembly. In order to improve precision, the male and female portions of the latch blocks should engage as much as possible without increasing the difficulty of assembly.

Figure 1:
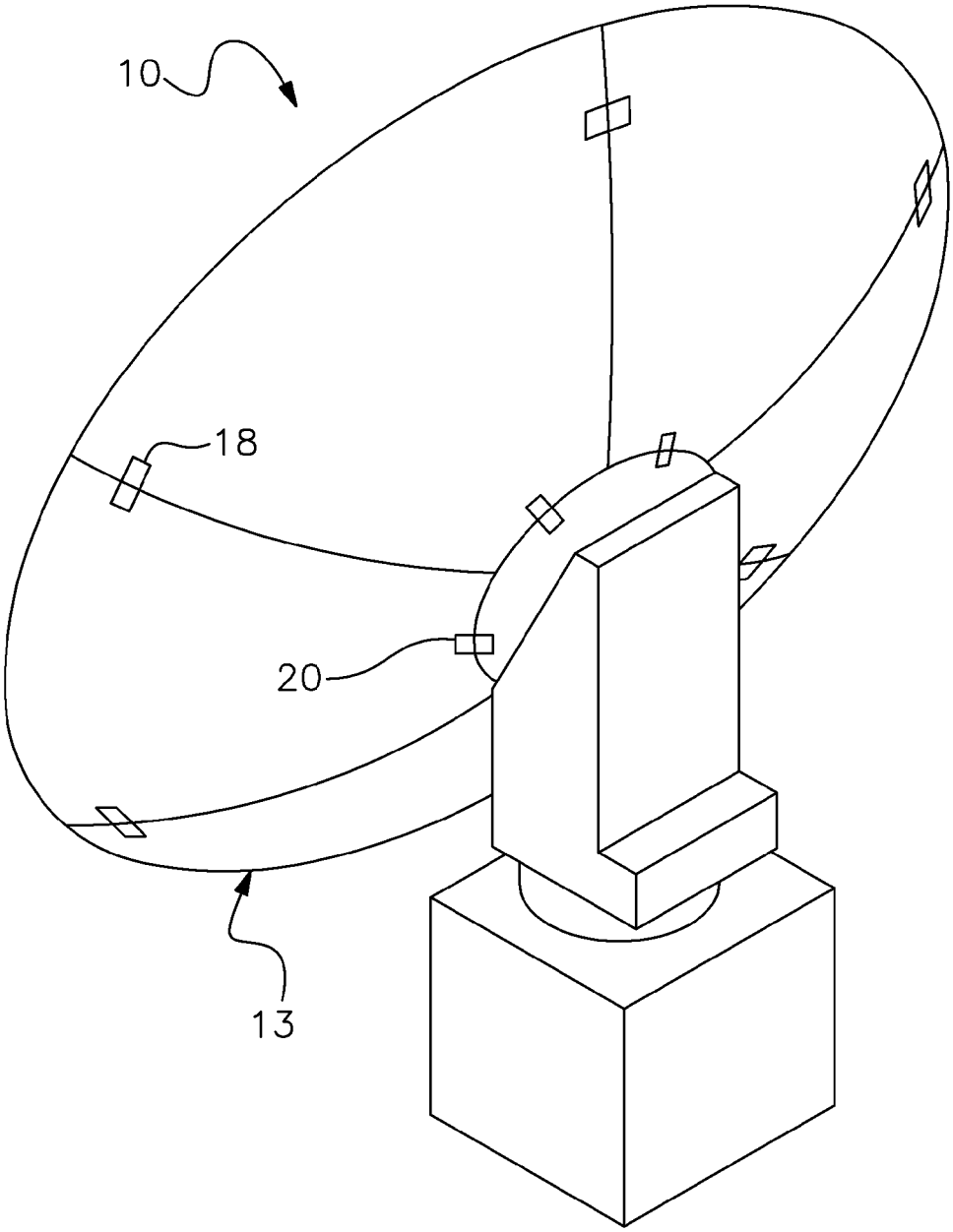
FIG. 1 is a generalized perspective view showing the rear of a ground-based satellite communication apparatus incorporating features of the subject invention.
Figure 1A:
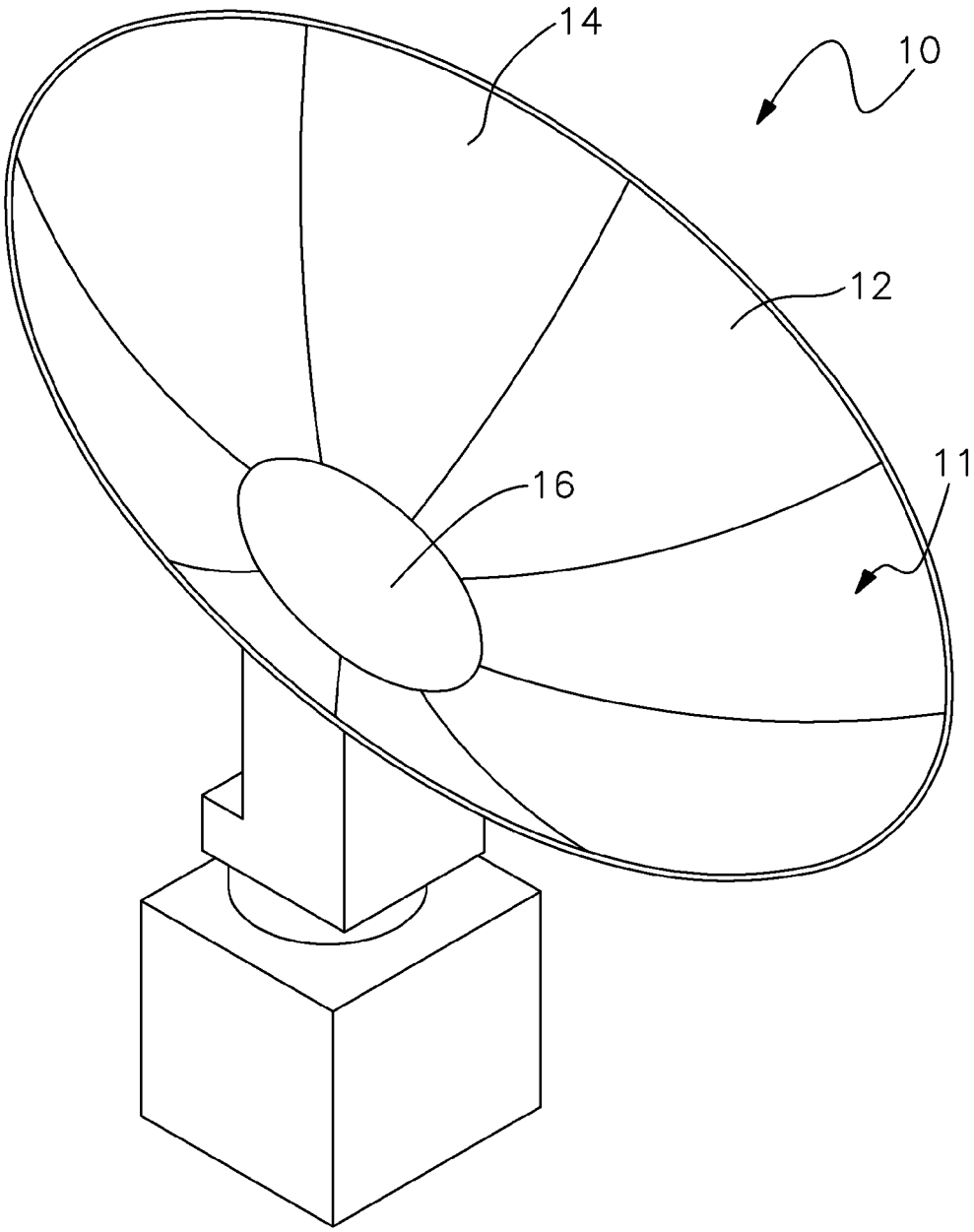
FIG. 1A is a generalized perspective view showing the front of the apparatus of FIG. 1.
Figure 2:
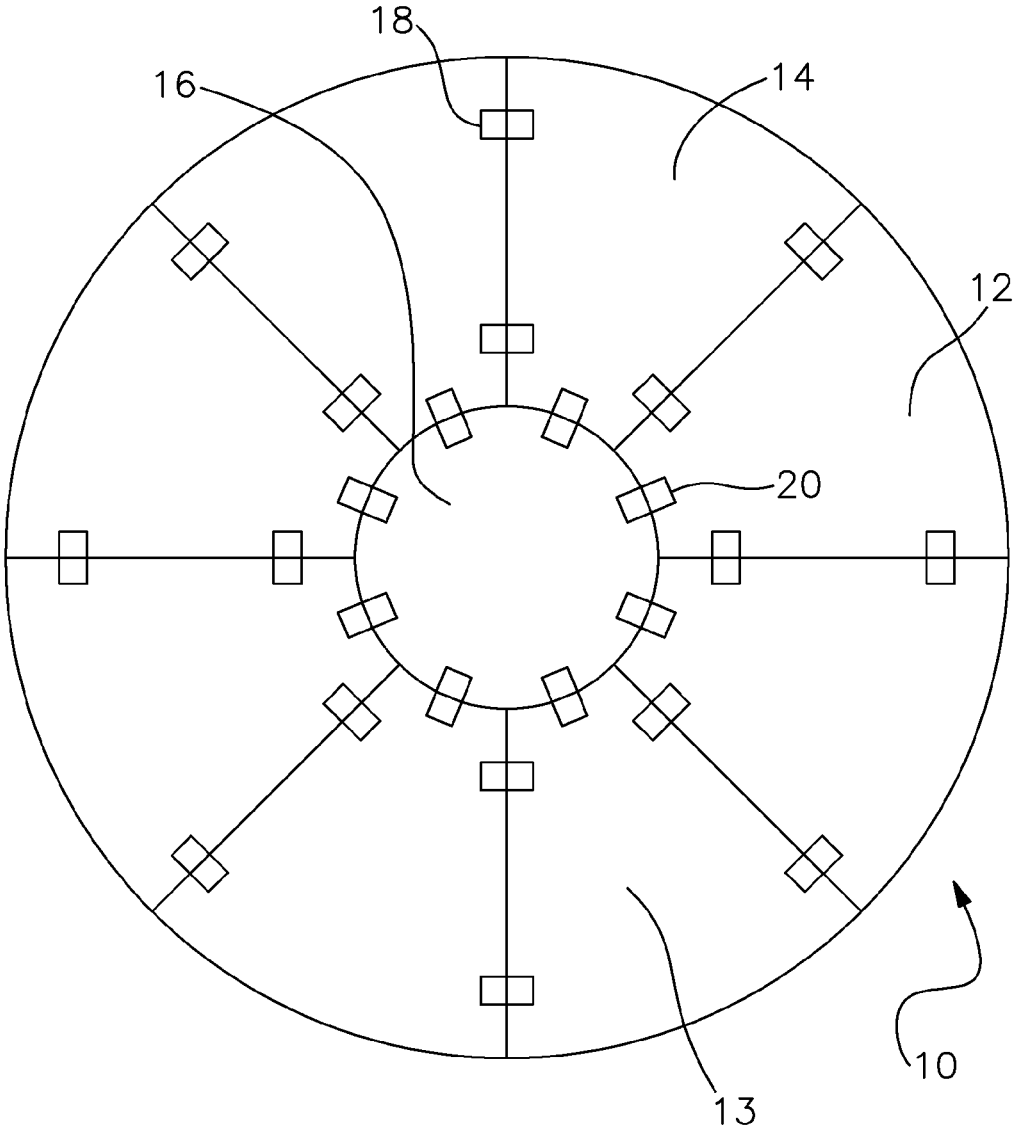
FIG. 2 is a rear elevational view of only the reflector portion of the apparatus of FIG. 1.

As generally shown in FIGS. 1, 1A and 2, reflector 10 includes a plurality of circumferential panel segments 12 and 14, as well as central hub panel segment 16. As can be seen in FIG. 1A, circumferential panel segments 12 and 14 as well as the other panel segments are configured to be connected together so that the front side 11 of reflector 10, and thus the panel segments, defines a substantially continuous surface. As can be seen in FIGS. 1 and 2, circumferential latches 18 on the rear side 13 of reflector 10 are used to connect adjacent circumferential segments 12 and 14 together while radial latches 20 are used to connect each circumferential segment, such as segment 12 to hub segment 16 as shown in more detail in FIG. 3. Radial latch 20 is formed from a pair of latch blocks shown in FIG. 4, namely, male half 22 and female half 24. Male half 22 may be connected to the hub 16 and the female half 24 may be connected to the circumferential segment 12 or vice-versa.

Figure 3:
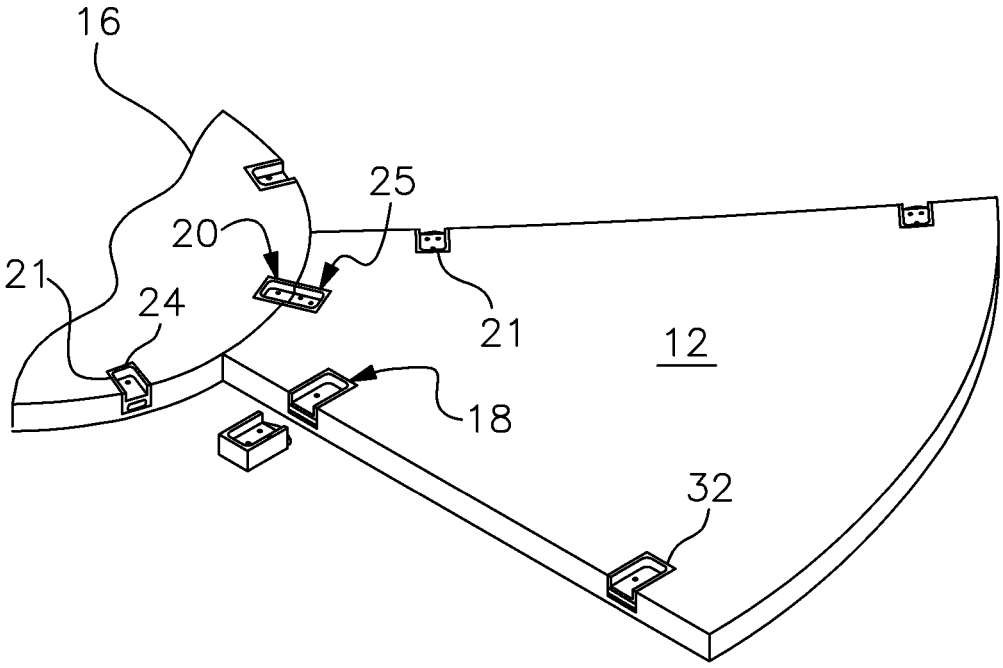
FIG. 3 shows one circumferential reflector segment connected to a hub reflector segment.
Figure 4:
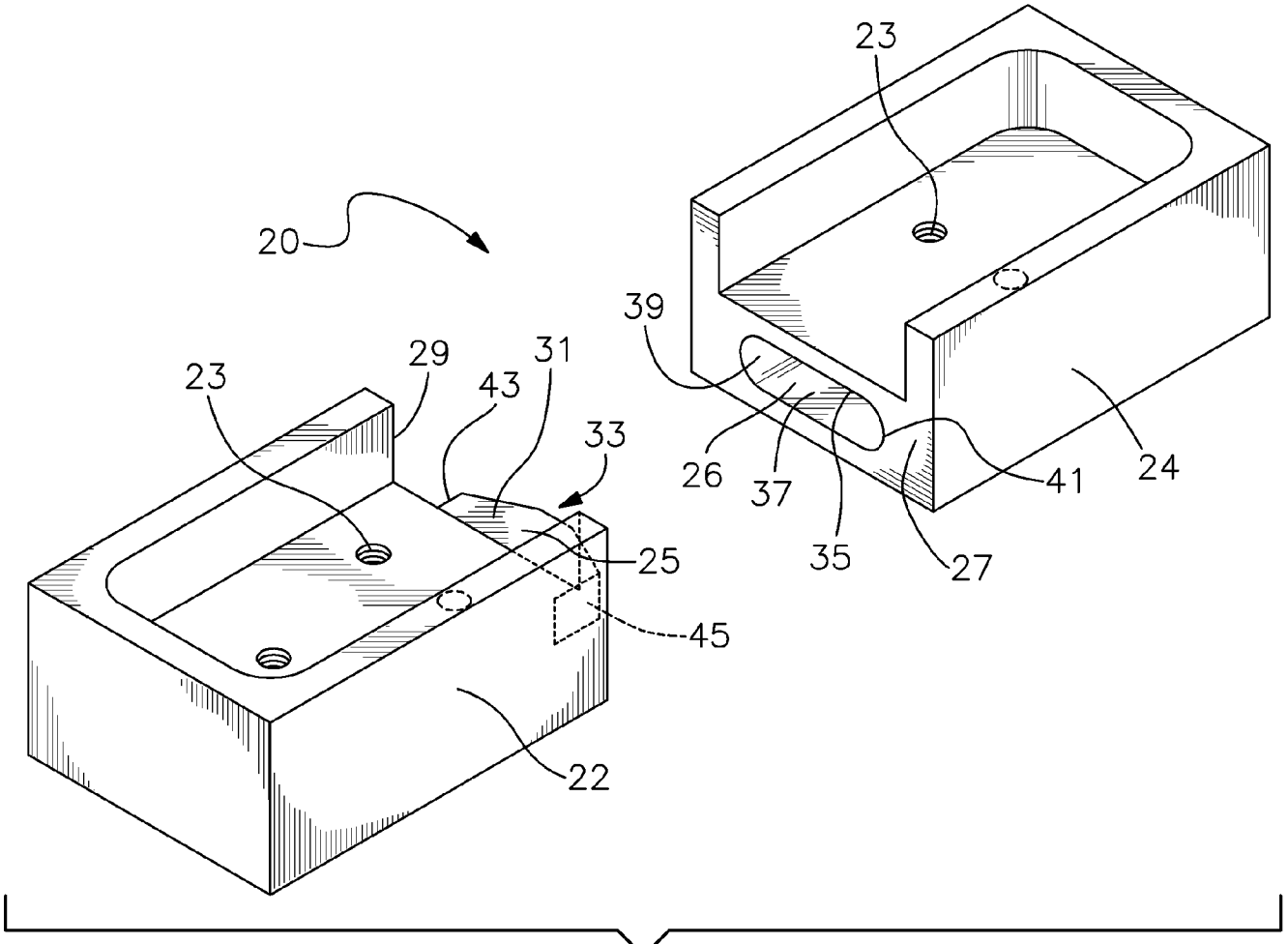
FIG. 4 is a perspective view showing a separated pair of inter-mateable radial latch blocks for connecting a circumferential panel segment to a hub segment.
Figure 7:
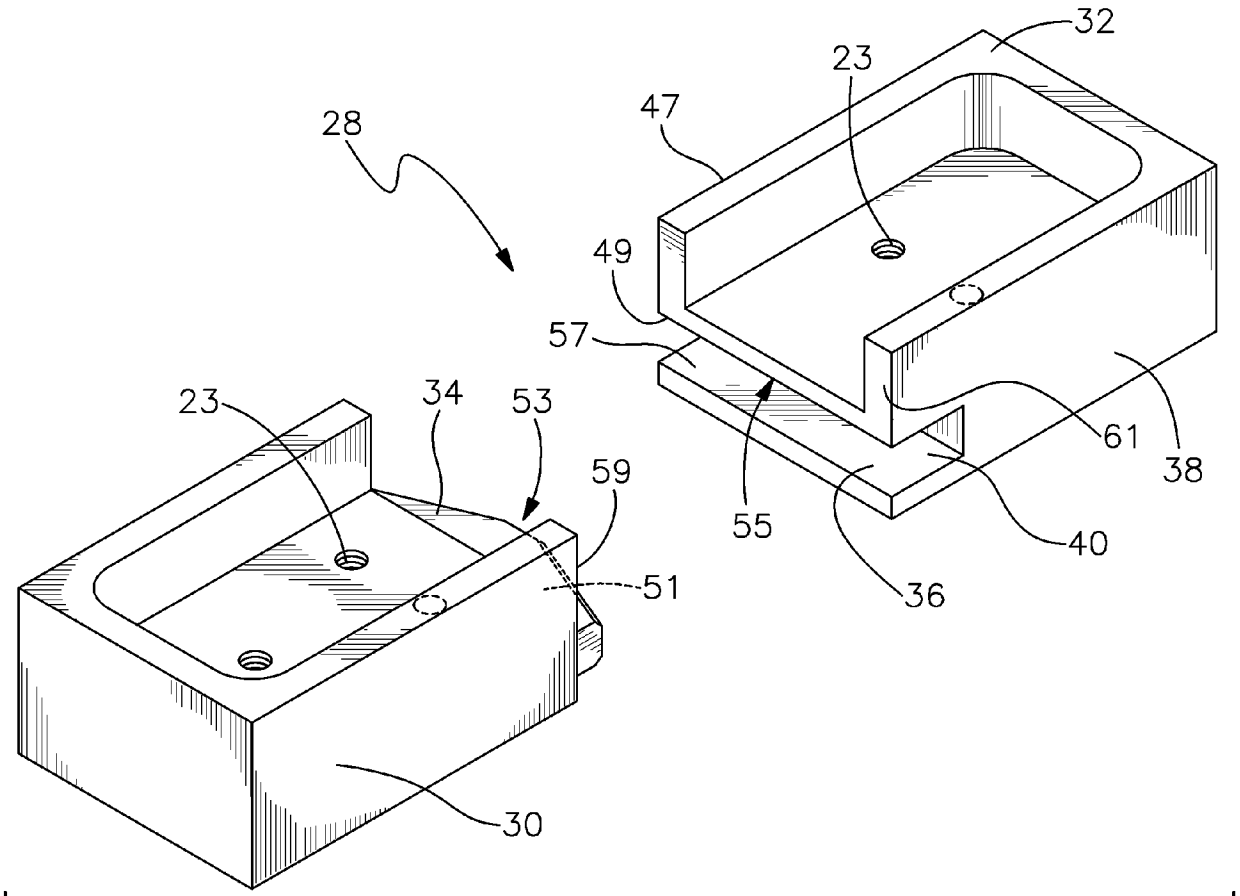
FIG. 7 is a perspective view showing a pair of inter-mateable circumferential latch blocks for connecting adjacent circumferential panel segments.

Preferably, the latch blocks shown in FIGS. 4 and 7 are made from a metal such as aluminum and may be cast, machined, or wrought. Referring to FIG. 4, radial latch blocks 22 and 24 each include a plurality of holes 23 which receive corresponding screws for securing a clamping mechanism (not shown) thereto for holding the latch blocks together when the reflector 10 is assembled and for releasing the latch blocks at the time of disassembly. Referring to FIG. 7, circumferential latch blocks 30 and 32 also include a plurality of holes 23 for securing the clamping mechanism thereto. As shown in FIG. 3, circumferential latches 18 are received in slots 21 in circumferential panels 12 and 14 and are preferably permanently affixed into those slots using an affixing mechanism or material such as glue. Radial latches 20 are received in slots 25 in circumferential panels 12 and 14 and hub panel 16 and are preferably permanently affixed into those slots using an affixing mechanism or material such as glue.

Figure 5:
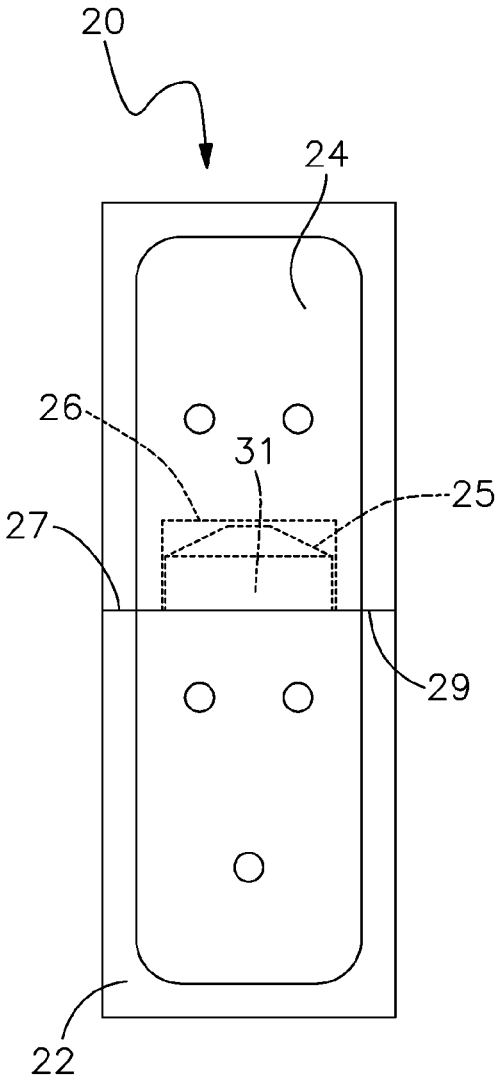
FIG. 5 is a top view of the latch blocks of FIG. 4 having been inter-mated.
Figure 6:
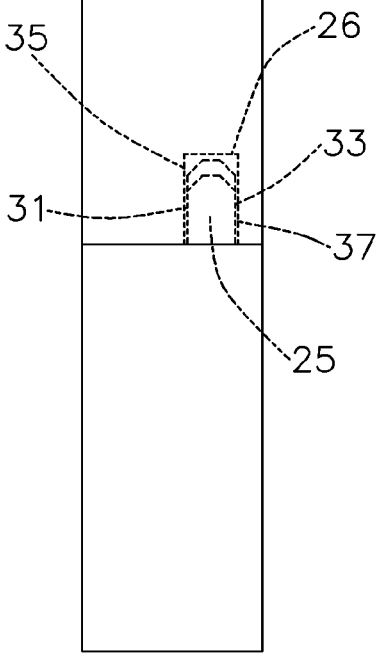
FIG. 6 is a side elevational view of the inter-mated latch blocks of FIG. 5.

Latch block 22, which is the male half of latch 20, includes protrusion 25 and latch block 24, which is the female half, includes a recess or cavity 26 which receives protrusion 24 when respective abutting surfaces 27 and 29 make contact when latch blocks 22 and 24 are inter-mated as shown in FIGS. 5 and 6. As will be explained below, the protrusion and recess arrangement shown in FIG. 4 secures latch blocks 22 and 24 together and thus a circumferential panel segment 12 and hub panel segment 16 together in three axes. Protrusion 25 includes upper surface 31 and lower surface 33. Recess 26 includes upper wall 35 and lower wall 37. The upper surface 31 of protrusion 25 is immediately adjacent to the upper wall 35 of recess 26 and the lower surface 33 of protrusion 25 is immediately adjacent to the lower wall 37 of recess 26 when the respective abutting surfaces 27 and 29 contact one another. The contact of the respective abutting surfaces 27 and 29 of latch blocks 22 and 24 maintain those latch blocks and adjacent reflector segments in a predetermined configuration in a first axis. The immediate adjacency of the upper surface 31 of protrusion 25 with the upper wall 35 of recess 26 and the immediate adjacency of the lower surface 33 of protrusion 25 with the lower wall 37 of recess 26 maintains the latch blocks and adjacent reflector segments in a predetermined configuration in a second axis. Recess 26 further includes left side wall 39 and right side wall 41. Protrusion 25 includes left side surface 43 and right side surface 45. The left side wall 39 of recess 26 is immediately adjacent to the left side surface 43 of protrusion 25 and the right side wall 41 of recess 26 is immediately adjacent to the right side surface 45 of protrusion 25 when the respective abutting surfaces 27 and 29 contact one another. The immediate adjacency of the left side surface 43 of protrusion 25 with the left side wall 39 of recess 26 and the immediate adjacency of the right side surface 45 of protrusion 25 with the right side wall 41 of recess 26 maintains the latch blocks and adjacent reflector segments in a predetermined configuration in a third axis.

Figure 8:
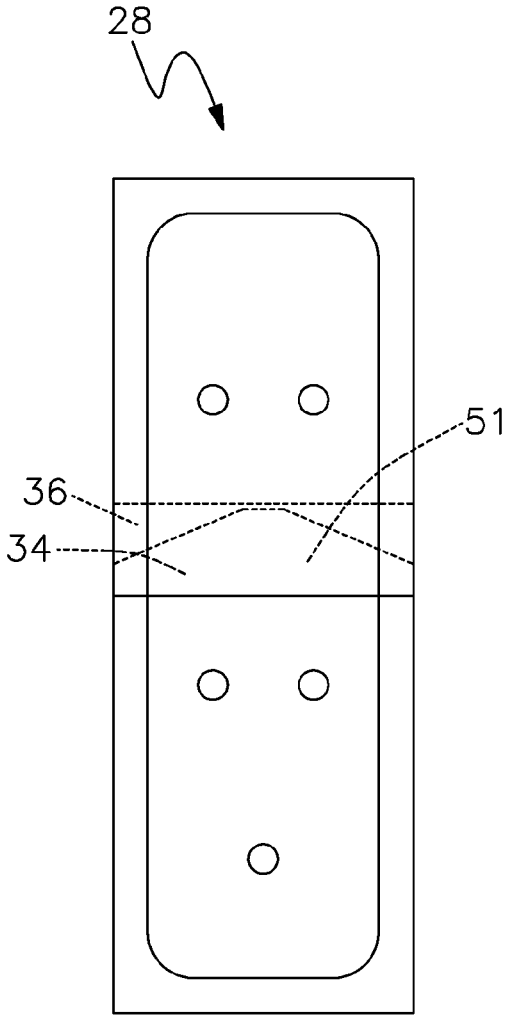
FIG. 8 is a top view of the latch blocks of FIG. 7 which have been inter-mated.
Figure 9:
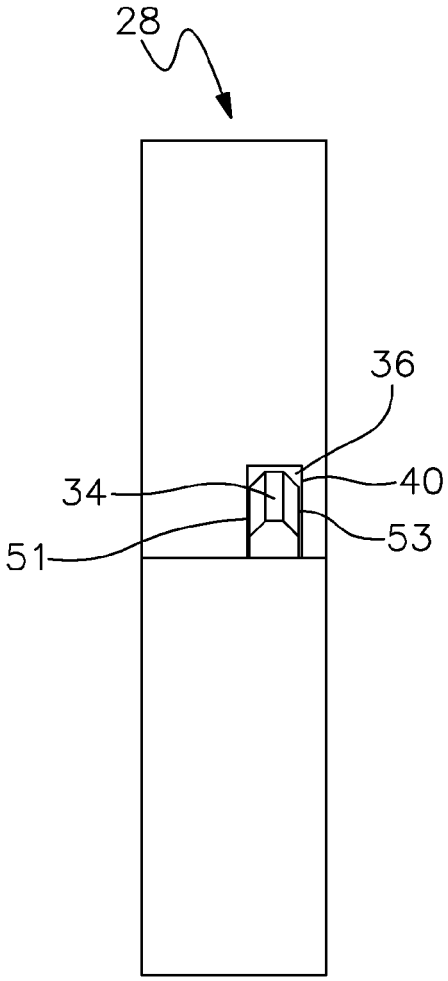
FIG. 9 is a side elevational view of the inter-mated latch blocks of FIG. 8.

FIG. 7 shows circumferential latch 28 including latch block 30, which is the male half, and latch block 32, which is the female half. Latch block 30 includes protrusion 34. Latch block 32 includes recess 36 for receiving protrusion 34. Latch block 32 includes side walls 38 and 47. Recess 36 includes at least one side wall opening, and preferably two, such as openings 40 and 49 in side walls 38 and 47 so as to form a slot. This recess or slot 36 with its openings 40 and 49 along a portion of the side walls enables protrusion 34 from latch block 30 to slide into the recess 36 from either side through opening 40 or 49, thereby making assembly of adjacent circumferential panels 12 and 14 much easier. This is also illustrated in FIGS. 8 and 9 whereby the protrusion 34 is fully inserted into slot 36. Protrusion 34 includes upper surface 51 and lower surface 53. Recess 36 includes upper wall 55 and lower wall 57. Latch block 30 includes abutting surface 59 and latch block 32 includes abutting surface 61. The upper surface 51 of protrusion 34 is immediately adjacent to the upper wall 55 of latch block 32 and the lower surface 53 of protrusion 34 is immediately adjacent to the lower wall 57 of latch block 32 when abutting surfaces 59 and 61 contact one another. The immediate adjacency of the upper surface 51 of protrusion 34 with the upper wall 55 of recess 36 and the immediate adjacency contact of the lower surface 53 of protrusion 34 with the lower wall 57 of recess 36 maintains the latch blocks 34 and 32 and the adjacent reflector segments, which they are connected to, in a predetermined configuration in a second axis. The protrusion 34 and slot 36 arrangement shown in FIG. 7 and the contact of the abutting surfaces 59 and 61 secures latch blocks 30 and 32 and thus adjacent panels 12 and 14 in two planes or axes.

A standard clamp assembly, known to those skilled in the art, is received in hollowed out portions on the top of the latch blocks and is used to hold the two latch blocks 30 and 32 together after the assembly has taken place. A clamp assembly is not shown in reference to FIGS. 1-9 so that the invention may be more readily illustrated. However, a clamp assembly is shown in reference to FIGS. 11 and 12 as is described below.

Figure 10:
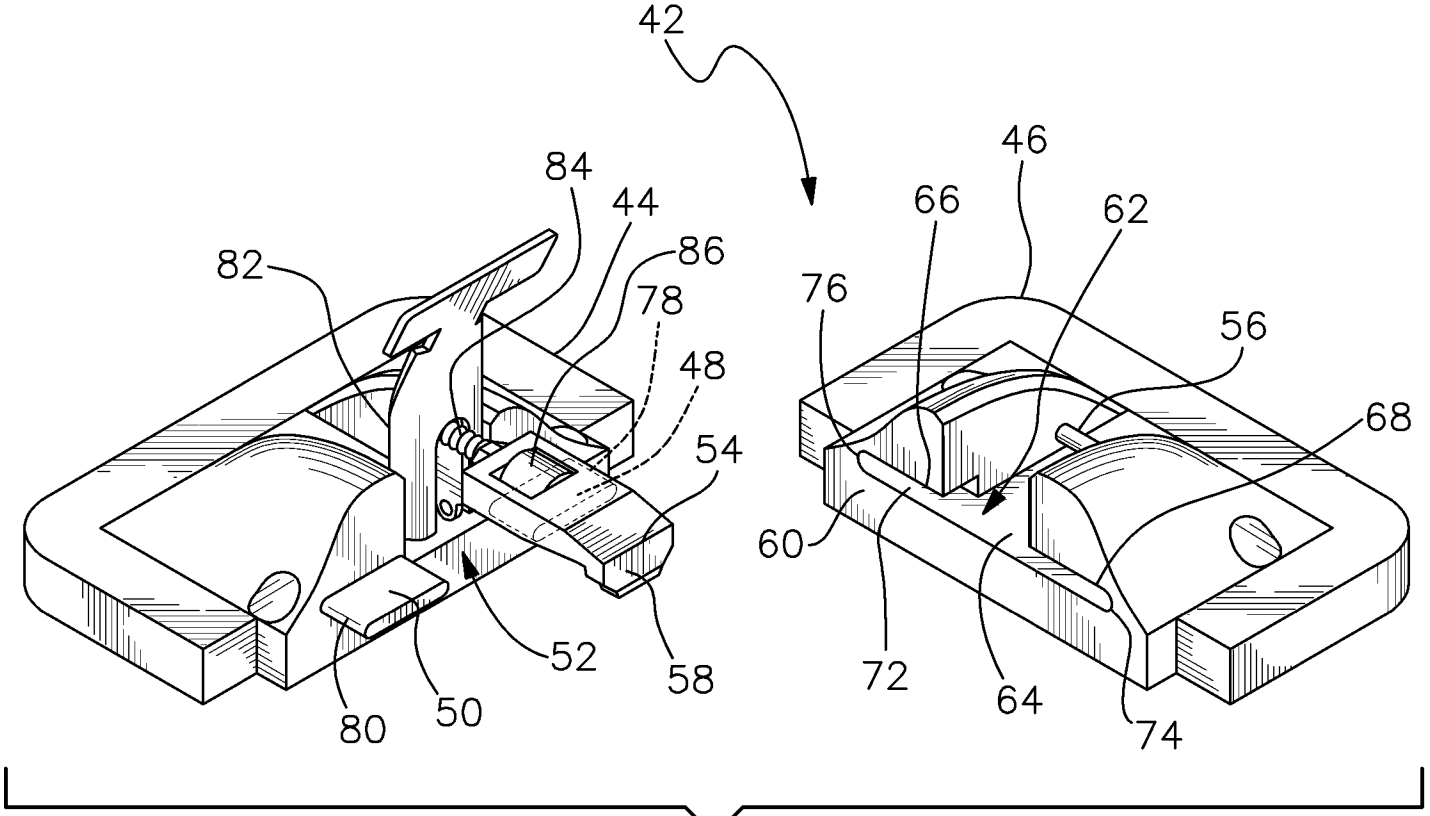
FIG. 10 is a perspective view of an alternative embodiment of the invention showing a separated pair of inter-matable radial latch blocks for connecting a panel segment to a hub segment.
Figure 11:
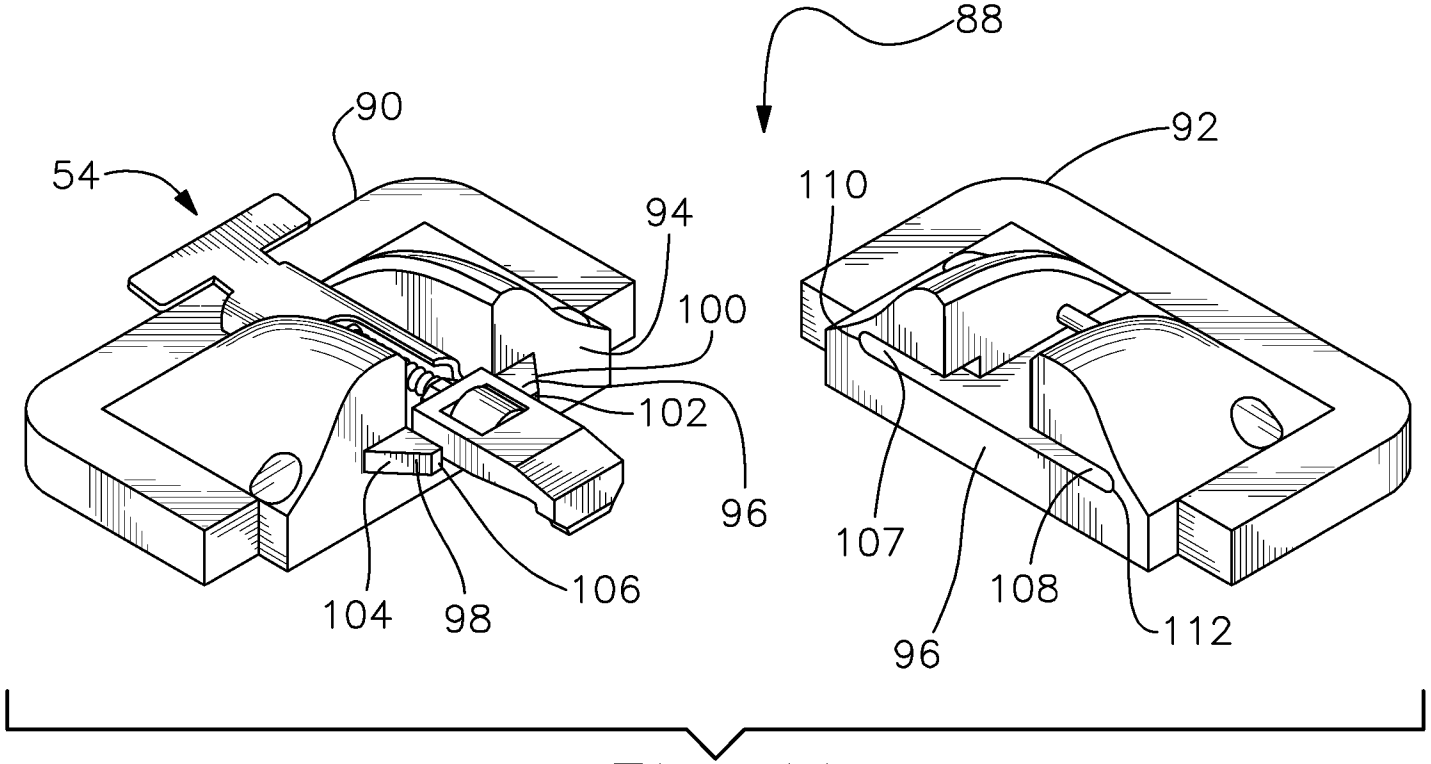
FIG. 11 is a perspective view of an alternative embodiment of the invention showing a separated pair of inter-matable circumferential latch blocks for connecting circumferential panel segments together.
Figure 12:
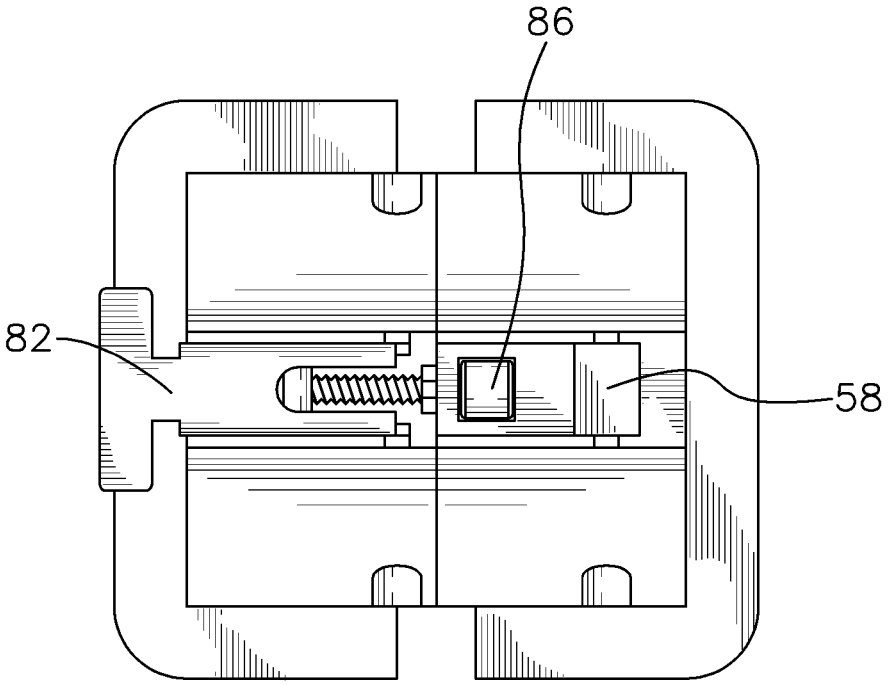
FIG. 12 shows the inter-matable latch blocks of either FIG. 10 or FIG. 11 connected together.

FIGS. 10 through 12 show an alternative embodiment of the invention which is particularly useful for smaller reflectors. FIG. 10 shows radial latch 42 including latch block 44, which is the male, and latch block 46, which is the female. Latch blocks 44 and 46 are adapted to be connected between circumferential panel segments 12 and the hub panel segment similar to the latch blocks which have been previously described. Latch block 44 includes a pair of protrusions 48 and 50 extending from mating face 52. Latch block 44 includes adjustable clamp 54 attached to the body of latch block 44. Latch block 46 includes bar 56 which receives the hook portion 58 of clamp assembly 54 for securing latch blocks 44 and 46 together. Latch block 46 includes abutting surface 60 which makes contact with abutting surface 52 of latch block 44. Latch block 46 includes recess 62 in abutting surface 60, including a continuous bottom wall 64 and a discontinuous top wall including wall 66 and wall 68 forming two separate groove portions, namely groove portion 70 and groove portion 72, each being open on one side. Groove portion 70 includes side wall 74. Groove portion 72 includes side wall 76. Protrusion 48 of latch block 44 includes side surface 78 and protrusion 50 includes side surface 80. Side surface 78 is immediately adjacent to side wall 70 and side surface 80 is immediately adjacent to side wall 74 when protrusion 48 is inserted in groove 72 and when protrusion 50 is inserted in groove 70. Thus, the distance between side surfaces 78 and 80 is substantially the same as the distance between side wall 74 and side wall 76. As with the embodiment of FIGS. 4 and 7, the top surfaces of protrusions 48 and 50 are immediately adjacent to the top wall of the grooves 70 and 72 and the bottom surfaces of protrusions 48 and 50 are immediately adjacent to the bottom walls of grooves 70 and 72. The embodiment of FIG. 10 maintains the hub panel and the circumferential panels together in three axes.

Clamp assembly 54 includes hook portion 58 and lever 82. Hook portion 58 is connected to lever 82 through threaded rod 84. Extension and retraction of hook portion 58 can be adjusted by adjustment screw 86 connected to threaded rod 84 and clamp assembly 54.

Referring now more particularly to FIG. 11, there is provided circumferential latch 88 which is used to connect adjacent circumferential reflector panels together. Latch 88 includes male latch block 90 and female latch block 92. Female latch block 92 may be identical to female latch block 46 shown in FIG. 10.

Latch block 90 may include the same clamping mechanism as the clamping mechanism shown in FIG. 10. Latch block 90 includes abutting surface 94 which contacts abutting surface 96 of latch block 92 when the latch blocks are connected together. Latch block 90 includes projections 96 and 98 which extend from abutting surface 94. Projection 96 includes side surface 100 which extends inwardly from its connection to abutting surface 94 to its free end 102. Projection 98 includes side surface 104 which extends inwardly from abutting surface 94 to its free end 106. Latch block 92 includes slots 107 and 108 having side walls 110 and 112. The distance between side walls 110 and 112 is greater then the distance between protrusions 96 and 98. This distance differential and the fact that the side walls 100 and 104 of projections 96 and 98 slope inwardly make the assembly of the adjacent circumferential reflector segments easier.

From the foregoing description of the embodiments of the invention, it will be apparent that many modifications may be made therein. It will be understood that these embodiments of the invention are an exemplification of the invention only and that the invention is not limited thereto.

The invention claimed is:

1. An antenna reflector comprising:

at least first and second reflector segments; the first and second reflector segments each having first and second sides; the first and second reflector segments being configured to be connected together wherein the first sides of the first and second reflector segments define a substantially continuous surface of an antenna reflector;

a first latch member attached to the second side of the first reflector segment;

a second latch member attached to the second side of the second reflector segment;

each latch member including an abutting surface; the respective abutting surfaces of each latch member contacting one another when the first and second reflector segments are connected together;

at least one protrusion extending from the abutting surface of the first latch member; the protrusion having upper and lower surfaces;

at least one recess in the abutting surface of the second latch member; the recess having upper and lower walls, and the protrusion received in the recess when the respective abutting surfaces contact one another, and the upper surface of the protrusion is immediately adjacent to the upper wall of the recess, and the lower surface of the protrusion is immediately adjacent to the lower wall of the recess, whereby the contact of the abutting surfaces maintains the first and second latch members and the first and second reflector segments in a first axis and the immediate adjacency of the upper surface of the protrusion and the lower wall of the recess, and the immediate adjacency of the lower surface of the protrusion and the lower wall of the recess maintain the first and second latch members and the first and second reflector segments in a second axis.

2. An antenna reflector as set forth in claim further including a mechanism for fastening the first and second latch members together.

3. An antenna reflector as set forth in claim 2 wherein each latch member includes a hollowed out top portion; the mechanism for fastening received in the hollowed out top portion of adjacent latch members.

4. An antenna reflector as set forth in claim 3 wherein the mechanism for fastening includes a clamp attached to one of the first or second latch members; the mechanism for fastening further includes a rod attached to the other of the first or second latch members; a portion of the clamp engaging the rod when the first and second latch members are connected together.

5. An antenna reflector as set forth in claim 1 wherein the recess has left and right side walls; the protrusion having left and right side surfaces; the left side wall being immediately adjacent to the left side surface and the right side wall being immediately adjacent to the right side surface when the respective abutting surfaces contact one another.

6. An antenna reflector as set forth in claim 5 wherein the immediate adjacency of the left side surface of the protrusion with the left side wall of the recess and the immediate adjacency of the right side surface of the protrusion with the right side wall of the recess maintaining the first and second latch members and first and second reflector segments in a predetermined configuration in a third axis.

7. An antenna reflector as set forth in claim 5 wherein one of the first or second reflector segments being a circumferential segment and the other of the first or second reflector segments being a hub segment.

8. An antenna reflector as set forth in claim 1 wherein the sides of the recess are open.

9. An antenna reflector as set forth in claim 8 wherein the protrusion extends across a substantial portion of the entire width of the first latch member.

10. An antenna reflector as set forth in claim 8 wherein the first and second reflector segments are circumferential segments.

11. An antenna reflector as set forth in claim 1 wherein the protrusion is wedge shaped.

12. An antenna reflector as set forth in claim 1 wherein the at least one protrusion includes first and second protrusions; the at least one recess includes first and second recesses; the first and second recesses each having lower walls; the lower walls being joined together along the same surface plane.

13. An antenna reflector as set forth in claim 1 wherein the width of the recess is substantially greater than the width of the protrusion.

14. A latch system for connecting first and second antenna reflector segments together comprising:

the first and second reflector segments each having first and second sides; the first and second reflector segments being configured to be connected together wherein the first sides of the first and second reflector segments define a substantially continuous surface of an antenna reflector;

a first latch member attached to the second side of the first reflector segment;

a second latch member attached to the second side of the second reflector segment;

each latch member including an abutting surface; the respective abutting surfaces of each latch member contacting one another when the first and second reflector segments are connected together;

at least one protrusion extending from the abutting surface of the first latch member;

at least one recess in the abutting surface of the second latch member; and the protrusion received in the recess when the respective abutting surfaces contact one another; the protrusion having an upper surface and a lower surface; the recess having an upper wall and a lower wall; the upper surface of the protrusion immediately adjacent to the upper wall of the recess and the lower surface of the protrusion immediately adjacent to the lower wall of the recess when the respective abutting surfaces contact one another.

15. A latch system as set forth in claim 14, further including a mechanism for fastening the first and second latch members together.

16. A latch system as set forth in claim 15 wherein each latch member includes a hollowed out top portion; the mechanism for fastening received in the hollowed out top portion of adjacent latch members.

17. A latch system as set forth in claim 16 wherein the mechanism for fastening includes a clamp attached to one of the first or second latch members; the mechanism for fastening further includes a rod attached to the other of the first or second latch members; a portion of the clamp engaging the rod when the first and second latch members are connected together.

18. A latch system as set forth in claim 14 wherein the recess has left and right side walls; the protrusion having left and right side surfaces; the left side wall immediately adjacent to the left side surface and the right side wall immediately adjacent to the right side surface when the respective abutting surfaces contact one another.

19. A latch system asset forth in claim 18 wherein the contact of the respective abutting surfaces of the first and second latch members maintain the first and second reflector segments in a predetermined configuration in a first axis; the immediate adjacency of the upper surface of the protrusion with the upper wall of the recess and the immediate adjacency of the lower surface of the protrusion with the lower wall of the recess maintaining the first and second reflector segments in a predetermined configuration in a second axis; the immediate adjacency of the left side surface of the protrusion with the left side wall of the recess and the immediate adjacency of the right side surface of the protrusion with the right side wall of the recess maintaining the first and second reflector segments in a predetermined configuration in a third axis.

20. A latch system as set forth in claim 18 wherein one of the first or second reflector segments being a circumferential segment and the other of the first or second reflector segments being a hub segment.

21. A latch system as set forth in claim 14 wherein the sides of the recess are open.

22. Match system as set forth in claim 21 wherein the first and second reflector segments are circumferential segments.

23. A latch system as set forth in claim 14 wherein the protrusion extends across a substantial portion of the entire width of the first latch member.

24. A latch system as set forth in claim 14 wherein the protrusion is wedge shaped.

25. A latch system as set forth in claim 14 wherein the contact of the respective abutting surfaces of the first and second latch members maintain the first and second reflector segments in a predetermined configuration in a first axis; the immediate adjacency of the upper surface of the protrusion with the upper wall of the recess and the immediate adjacency of the lower surface of the protrusion with the lower wall of the recess maintaining the first and second reflector segments in a predetermined configuration in a second axis.

26. A latch system as set forth in claim 14 wherein the at least one protrusion includes first and second protrusions; the at least one recess includes first and second recesses; the first and second recesses each having lower walls; the lower walls being joined together along the same surface plane.

27. An antenna reflector as set forth in claim 14 herein the width of the recess is substantially greater than the width of the protrusion.

28. An antenna reflector comprising:

at least first and second reflector segments; the first and second reflector segments each having first and second sides; the first and second reflector segments configured to be connected together wherein the first sides of the first and second reflector segments define a substantially continuous surface of an antenna reflector;

a first latch member attached to the second side of the first reflector segment;

a second latch member attached to the second side of the second reflector segment;

each latch member including an abutting surface; the respective abutting surface of each latch member contacting one another when the first and second reflector segments are connected together;

at least one protrusion extending from the abutting surface of the first latch member;

at least one recess in the abutting surface of the second latch member; the protrusion received in the recess when the respective abutting surfaces contact one another;

a mechanism for fastening the first and second latch members together wherein the respective abutting surfaces of the first and second latch members contact one another;

the protrusion having an upper surface and a lower surface;

the recess having an upper wall and a lower wall; the upper surface of the protrusion being immediately adjacent to the upper wall of the recess and the lower surface of the protrusion being immediately adjacent to the lower wall of the recess when the respective abutting surfaces contact one another; the contact of the respective abutting surfaces of the first and second latch members and the mechanism for fastening maintaining the first and second reflector segments in a predetermined configuration in a first axis; the immediate adjacency of the upper surface of the protrusion with the upper wall of the recess and the immediate adjacency of the lower surface of the protrusion with the lower wall of the recess maintaining the first and second reflector segments in a predetermined configuration in a second axis.

29. An antenna reflector as set forth in claim 28 wherein the recess has left and right side walls; the protrusion having left and right side surfaces; the left side wall being immediately adjacent to the left side surface and the right side wall being immediately adjacent to the right side surface when the respective abutting surfaces contact one another; the immediate adjacency of the left side surface of the protrusion with the left side wall of the recess and the immediate adjacency of the right side surface of the protrusion with the right side wall of the recess maintaining the first and second reflector segments in a predetermined configuration in a third axis.

30. An antenna reflector as set forth in claim 28 wherein the sides of the recess are open.

31. An antenna reflector as set forth in claim 28 wherein the width of the recess is substantially greater than the width of the protrusion.

* * * * *